US006578888B1

(12) United States Patent
Fayngersh et al.

(10) Patent No.: US 6,578,888 B1
(45) Date of Patent: Jun. 17, 2003

(54) MORTISE LOCK WITH AUTOMATIC DEADBOLT

(75) Inventors: Zakhary Fayngersh, West Hartford, CT (US); Damon J. Lenk, Bristol, CT (US)

(73) Assignee: Tesa Entry Systems Inc., Norcross, GA (US)

( * ) Notice: Subject to any disclaimer, the term of this patent is extended or adjusted under 35 U.S.C. 154(b) by 0 days.

(21) Appl. No.: 09/598,095

(22) Filed: Jun. 21, 2000

(51) Int. Cl.[7] ..... E05B 63/20

(52) U.S. Cl. ..... 292/332; 292/335; 292/169.14; 70/107; 70/151 R

(58) Field of Search ..... 292/332, 335, 292/DIG. 21, 169.14; 70/107, 110, 150, 151 A, 151 R, 486

(56) References Cited

U.S. PATENT DOCUMENTS

| | | | | |
|---|---|---|---|---|
| 168,986 | A | 10/1875 | Griscom | |
| 197,531 | A | 11/1877 | Vetter | |
| 286,580 | A | 10/1883 | Billings | |
| 289,542 | A | 12/1883 | Krings | |
| 302,657 | A | 7/1884 | Heizmann et al. | |
| 950,108 | A | 2/1910 | Lawrence | |
| 970,628 | A | 9/1910 | Leistler | |
| 1,057,663 | A | 4/1913 | Page | |
| 1,107,736 | A * | 8/1914 | Wilkinson | 292/335 |
| 1,126,181 | A | 1/1915 | Cleaver | |
| 1,299,195 | A * | 4/1919 | Kohn | 292/335 |
| 1,302,873 | A | 5/1919 | Stiff | |
| 1,469,829 | A | 10/1923 | Teich | |
| 1,559,423 | A | 10/1925 | Hartzler | |
| 1,627,420 | A | 5/1927 | Thomas | |
| 1,816,134 | A | 7/1931 | Wood | |
| 2,516,991 | A | 8/1950 | Heyer | |
| 2,519,808 | A | 8/1950 | Young et al. | |
| 2,823,538 | A | 2/1958 | Fresard | |
| 3,211,486 | A | 10/1965 | Crandell | |
| 3,235,301 | A | 2/1966 | Russell et al. | |
| 3,242,706 | A | 3/1966 | Check | |
| 3,257,136 | A | 6/1966 | Russell et al. | |
| 3,361,462 | A | 1/1968 | Foster | |
| RE26,677 | E | 10/1969 | Russell et al. | |
| 3,621,686 | A | 11/1971 | Klein | |
| 3,631,695 | A | 1/1972 | Velbert et al. | |
| 3,672,714 | A | 6/1972 | Schultz | |
| 3,750,433 | A | 8/1973 | Sanders | |

(List continued on next page.)

*Primary Examiner*—Flemming Saether
(74) *Attorney, Agent, or Firm*—Akin Gump Strauss Hauer & Feld, L.L.P.

(57) ABSTRACT

A mortise lock for a door is provided, including an automatic deadbolt mechanism for automatic projection of a deadbolt mounted in the lock housing form a retracted to an extended position upon closing of the door. The automatic deadbolt projecting mechanism for use in the mortise lock comprises a blocking element adapted to be pivotally mounted in the housing for movement relative to the housing between a first position where a blocking surface is adapted to engage the deadbolt for holding the deadbolt in the retracted position against the force of a deadbolt biasing means and a second position where the blocking surface does not engage the deadbolt. The blocking element is pivoted to the second position upon door closing by operation of internal, pivoting lock components, including a sensor adapted to be mounted in the housing for movement relative to the housing between an extended position and a retracted position. The sensor is adapted to contact a strike plate or door frame upon closing of the door for movement to the retracted position triggering automatically deadbolt projection to the extended position under the force of the deadbolt biasing means when.

9 Claims, 9 Drawing Sheets

U.S. PATENT DOCUMENTS

| | | | | | |
|---|---|---|---|---|---|
| 3,769,822 | A | | 11/1973 | Yulkowski | |
| 3,808,849 | A | | 5/1974 | Alexander | |
| 4,061,383 | A | | 12/1977 | Waldo | |
| 4,063,765 | A | | 12/1977 | Waldo | |
| 4,071,270 | A | | 1/1978 | Alexander | |
| 4,118,056 | A | | 10/1978 | Alexander | |
| 4,243,256 | A | | 1/1981 | Frydrych | |
| 4,262,504 | A | | 4/1981 | Inoue | |
| 4,286,812 | A | | 9/1981 | Sprekeler | |
| 4,389,061 | A | | 6/1983 | Foshee | |
| 4,462,230 | A | | 7/1984 | Evans | |
| 4,468,059 | A | | 8/1984 | Nelson et al. | |
| 4,470,278 | A | | 9/1984 | Hale et al. | |
| 4,470,279 | A | | 9/1984 | Neary et al. | |
| 4,561,684 | A | | 12/1985 | Marotto | |
| 4,583,382 | A | | 4/1986 | Hull | |
| 4,674,776 | A | | 6/1987 | James | |
| 4,695,082 | A | | 9/1987 | Marks | |
| 4,696,174 | A | | 9/1987 | Marks | |
| 4,765,663 | A | | 8/1988 | Raymond et al. | |
| 4,798,065 | A | | 1/1989 | DeForrest, Sr. | |
| 4,817,404 | A | | 4/1989 | Eisermann et al. | |
| 4,890,870 | A | | 1/1990 | Miron | |
| 4,950,005 | A | | 8/1990 | Cudd | |
| 4,988,133 | A | | 1/1991 | Shih | |
| 5,201,200 | A | | 4/1993 | Hauber | |
| 5,308,131 | A | | 5/1994 | Galindo et al. | |
| 5,395,144 | A | | 3/1995 | Galindo | |
| 5,604,970 | A | | 2/1997 | Aigner et al. | |
| 5,615,919 | A | | 4/1997 | Ivey | |
| 5,666,830 | A | | 9/1997 | Litvin | |
| 5,676,407 | A | | 10/1997 | Smallegan et al. | |
| 5,678,870 | A | | 10/1997 | Pelletier | |
| 5,820,177 | A | | 10/1998 | Moon | |
| 5,941,581 | A | * | 8/1999 | Heithe | 292/335 |
| 6,045,169 | A | * | 4/2000 | Frolov | 292/335 |

FOREIGN PATENT DOCUMENTS

| | | | | |
|---|---|---|---|---|
| DE | 75175 | | 5/1894 | |
| DE | 541556 | | 1/1932 | |
| DE | 127146 | | 3/1932 | |
| DE | 1938639 | | 2/1971 | |
| DE | 2031370 | | 12/1971 | |
| DE | 2136636 | | 2/1973 | |
| DE | 1938639 | | 5/1978 | |
| DE | 2160563 | | 9/1979 | |
| DE | 2827939 | | 1/1980 | |
| EP | 0115430 | | 8/1884 | |
| FR | 1016319 | * | 4/1950 | 292/335 |
| GB | 2039983 | * | 8/1980 | 292/335 |
| NO | 63812 | | 8/1941 | |
| WO | 9425709 | | 11/1994 | |

* cited by examiner

MORTISE LOCK WITH AUTOMATIC DEADBOLT

BACKGROUND

This invention relates generally to mortise locks for use in doors, and more particularly to a mortise lock having a deadbolt which automatically projects when the door is closed.

A mortise lock is designed to fit into a mortised recess formed in the edge of a door which is opposite to the edge of the door that is hinged to the door frame. The mortise lock generally includes a rectangular housing, or case, which encloses the lock components. One of the lock components includes a deadbolt which projects beyond the edge of the door and into an opening or strike plate in the door frame to lock the door in a closed position. The deadbolt is moveable to a retracted position inside the case to permit opening of the door by operation of a latch operator, such as a doorknob or lever handle.

Mortise locks are available which utilize deadbolts which project automatically upon closing of the door. Mortise locks with automatic deadbolts are often used in hotel room doors so that hotel guests do not need to independently and manually throw the deadbolts after closing their hotel room door.

Mortise lock assemblies with automatic deadbolts generally comprise a deadbolt biasing mechanism in the housing of the mortise lock assembly for continually biasing the deadbolt outwardly to the extended position. A stop mechanism within the housing holds the deadbolt in a retracted position against the force of the biasing mechanism when the door is opened. A trigger mechanism is provided for sensing the strike plate or door frame when the door is closed. The deadbolt trigger mechanism functions to release the deadbolt stop mechanism so that the deadbolt projects to the extended position into an opening in the strike plate or door frame for locking the door. The deadbolt trigger mechanism is usually associated with an auxiliary latch which is pivotally mounted in the housing for movement from an extended position beyond the edge of the door to a retracted position in the housing when the auxiliary latch engages the strike plate or door frame. When the latch operator is used to retract the deadbolt for unlocking and opening the door, the deadbolt stop mechanism reengages the deadbolt for holding the deadbolt in the retracted position.

Automatic deadbolt mortise lock assemblies often have problems with retaining the deadbolt in the retracted position. Inadvertent release of the deadbolt causes the deadbolt to project to the extended position before the door is closed. In addition, automatic deadbolt mortise lock assemblies sometimes require excessive force to manually retract the deadbolt or high door closing force to release the deadbolt stop mechanism. The high force requirements can result in overstressing and breakage of the deadbolt and deadbolt biasing mechanism.

For the foregoing reasons, there is a need for a mortise lock utilizing an automatic deadbolt which does not require excessive force to retract the deadbolt or to release the deadbolt stop mechanism upon door closing. The new mortise lock should also safely retain the deadbolt in the mortise lock assembly when the door is opened and prevent accidental projection of the deadbolt. The new mortise lock assembly should also be straightforward to manufacture and use.

SUMMARY

Therefore, it is an object of the present invention is to provide a mortise lock including an automatic deadbolt which can be easily retracted using a door knob or lever handle.

Still another object of the present invention is to provide a mortise lock including an automatic deadbolt which requires only normal door closing force for triggering deadbolt projection.

A further object of the present invention is to provide a mortise lock including an automatic deadbolt which does not accidentally project when the door is open.

According to the present invention, an automatic deadbolt mechanism is provided for a mortise lock of the type comprising a housing for accommodating the lock components including the deadbolt projecting mechanism, a deadbolt mounted in the housing for movement relative to the housing between a retracted and extended position, means for continuously biasing the deadbolt to the extended position, and means for moving the deadbolt to the retracted position of the deadbolt. The automatic deadbolt projecting mechanism for use in the mortise lock comprises a blocking element adapted to be pivotally mounted in the housing for movement relative to the housing. The blocking element has a first position where a blocking surface is adapted to engage the deadbolt for holding the deadbolt in the retracted position against the force of the deadbolt biasing means and a second position where the blocking surface does not engage the deadbolt. Means are provided for pivoting the blocking element to the second position. The blocking element pivoting means includes a sensor adapted to be mounted in the housing for movement relative to the housing between an extended position and a retracted position. The blocking element pivoting means is operative to pivot the blocking element to the second position when the sensor is in the retracted position. The sensor is adapted to contact the strike plate upon closing of the door for movement to the retracted position so that the deadbolt automatically moves to the extended position under the force of the deadbolt biasing means when the door is closed.

Also according to the present invention, a mortise lock is provided for mounting in a free edge of a door, the mortise lock comprising a housing, a deadbolt mounted in the housing for movement relative to the housing between a retracted position and an extended position, means for continuously biasing the deadbolt to the extended position and means for moving the deadbolt from the extended position to the retracted position of the deadbolt. A blocking element mounted in the housing for pivotal movement relative to the housing is biased to a first position where a blocking surface on the blocking element engages the deadbolt for holding the deadbolt in the retracted position against the force of the deadbolt biasing means and a second position where the blocking surface does not engage the deadbolt. Means are provided for pivoting the blocking element to the second position against the force of a blocking element biasing means. The blocking element pivoting means includes a sensor mounted in the housing for movement relative to the housing between an extended position and a retracted position where the sensor is inside of the housing. The blocking element pivoting means is operative to pivot the blocking element to the second position when the sensor is in the retracted position. The sensor is adapted to contact the strike plate upon closing of the door for movement to the retracted position so that the deadbolt automatically moves to the extended position under the force of the deadbolt biasing means when the door is closed.

An important feature of the present invention is the blocking element arrangement which is easily pivoted to the non-blocking position by the camming, pivotal action of the blocking element pivoting means. The latter includes a pivoting trigger hammer mounted in the housing adjacent the sensor for engagement and movement by the sensor when the sensor is moved to the retracted position. A pivoting release lever is mounted in the housing between the trigger hammer and the blocking element. The release lever is engaged for movement by the trigger hammer when the trigger hammer is pivoted by the sensor. The release lever cams the blocking element when the release lever is rotated for moving the blocking element to the second position. The result is an automatic deadbolt mechanism which requires minimal force upon door closing to trigger projection and to subsequently retract the deadbolt using the latch operator.

Additional objects, features and advantages of the present invention will be apparent from the following description in which references are made to the accompanying drawings.

BRIEF DESCRIPTION OF THE DRAWINGS

For a more complete understanding of the present invention, reference should now be had to the embodiments shown in the accompanying drawings and described below.

DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the Figures. Indeed, the components may be oriented in any direction and the terminology, therefore, should be understood as encompassing such variations unless specified otherwise.

Figure 1:
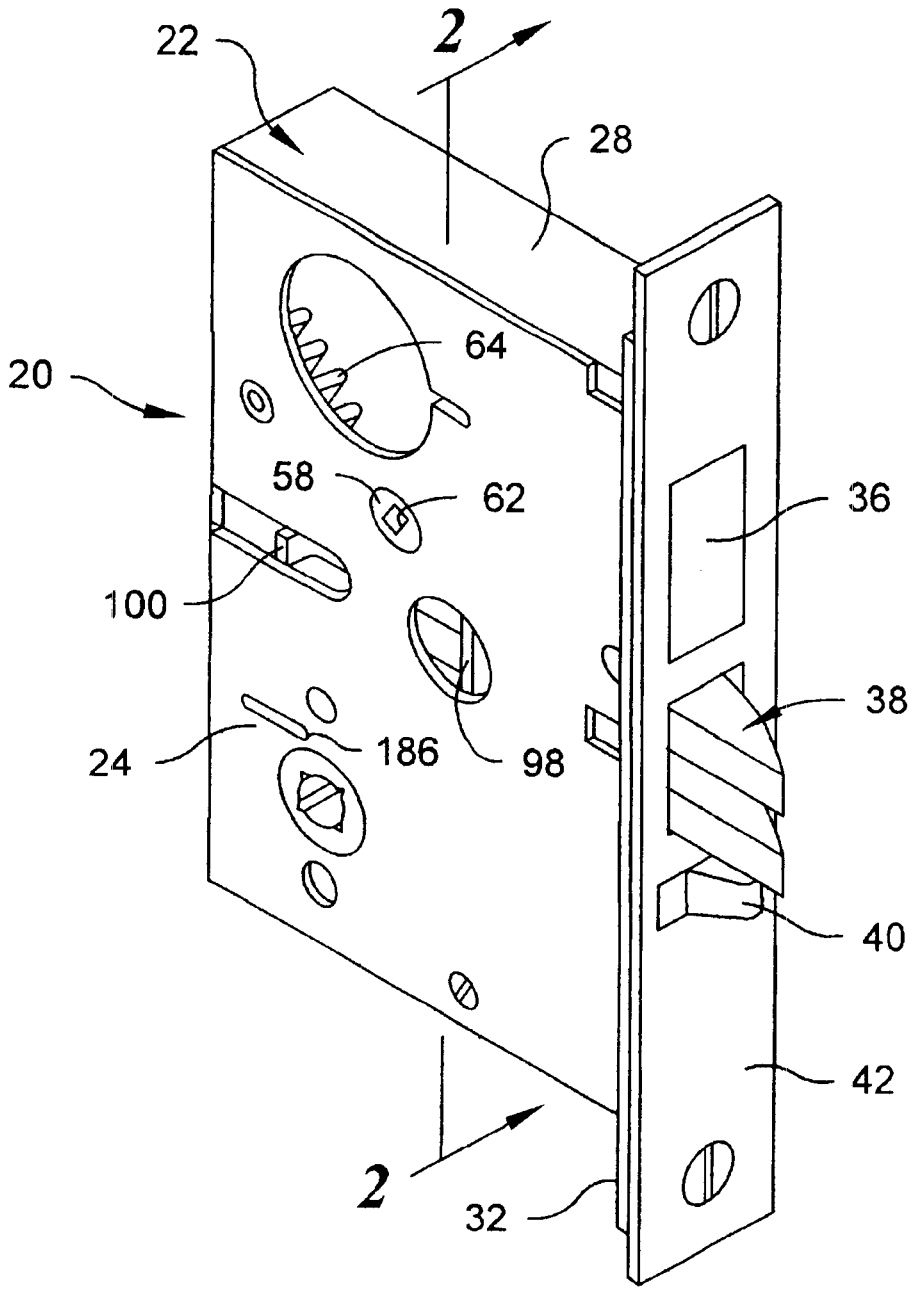
FIG. 1 is a perspective view of an embodiment of a mortise lock assembly according to the present invention.

Referring now to FIG. 1, an embodiment of a mortise lock assembly according to the present invention is shown and is generally designated by reference numeral 20. The lock 20 comprises a generally rectangular box, or case 22, for housing the lock components and is adapted to be received in a mortise in the free, or unhinged, edge of a door. One of the side walls of the case 22 comprises a cap 24 which is secured to and forms a closure for the case 22.

Figure 2:
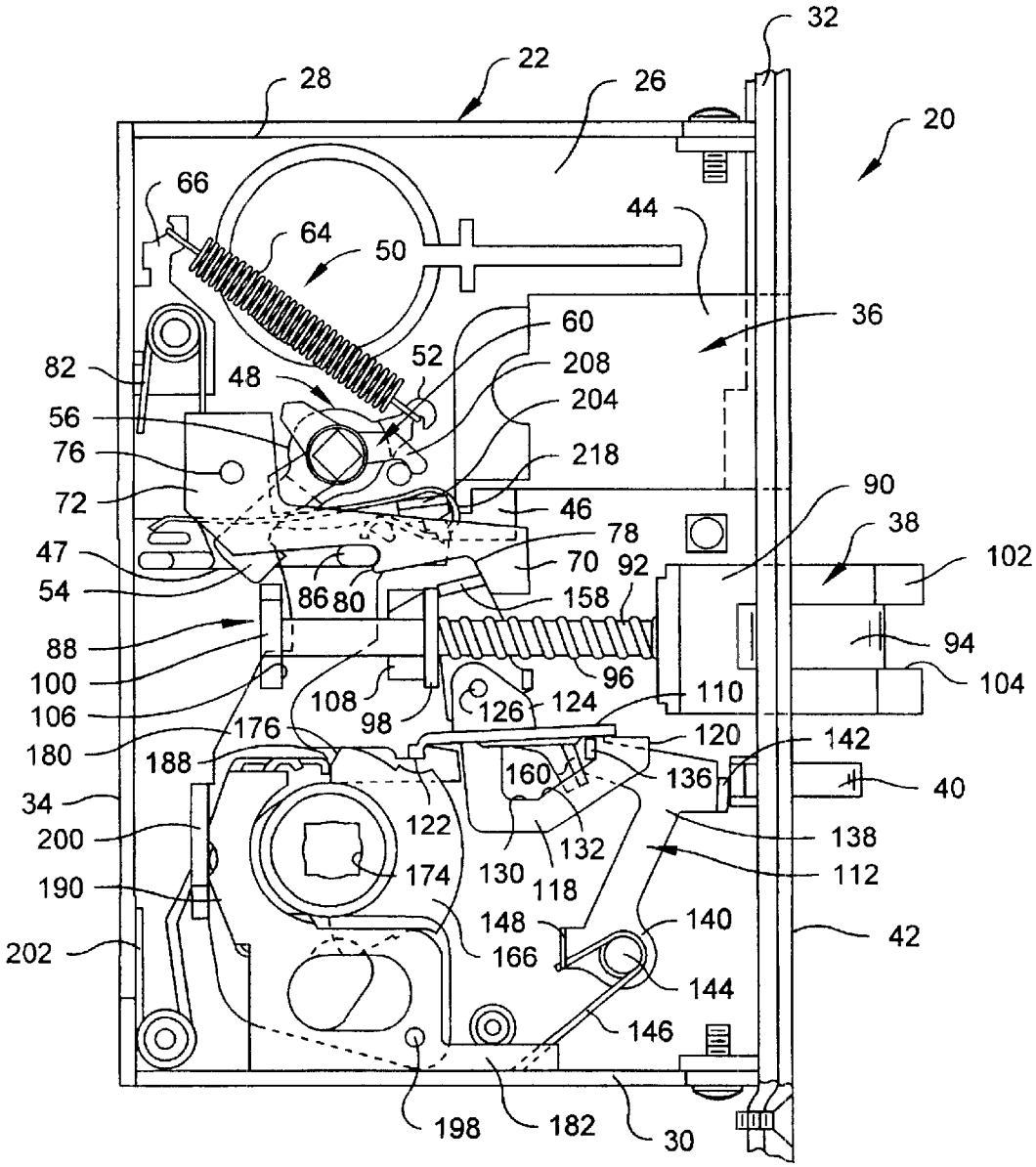
FIG. 2 is a side elevation view of the mortise lock assembly taken along line 2—2 of FIG. 1.

FIG. 2 shows the mortise lock assembly 20 with the cap side wall 24 removed. The case 22 includes a side wall 26 and, as seen in FIG. 2, integral top 28, bottom 30, front 32 and rear 34 walls. The front wall 32 has openings for a deadbolt 36, a latch bolt 38, and an auxiliary bolt 40. A face plate 42 is secured to the front wall of the case 22 and has openings which correspond to the openings in the front wall 32. The deadbolt 36 is shown in a fully retracted position within the housing, and the latch bolt 38 and auxiliary bolt 40 are shown in extended positions, projecting from their respective openings in the front wall 32 and face plate 42. FIG. 2 shows the configuration of the lock components when the door is open.

The deadbolt 36 comprises a rectangular head portion 44 and a rearwardly extending tail portion 46 having a slot 47. The deadbolt 36 is slideably mounted in the housing 22 for movement between the retracted position and an extended position (FIG. 4) where a substantial part of the head portion 44 of the deadbolt projects from the housing.

Figure 8:
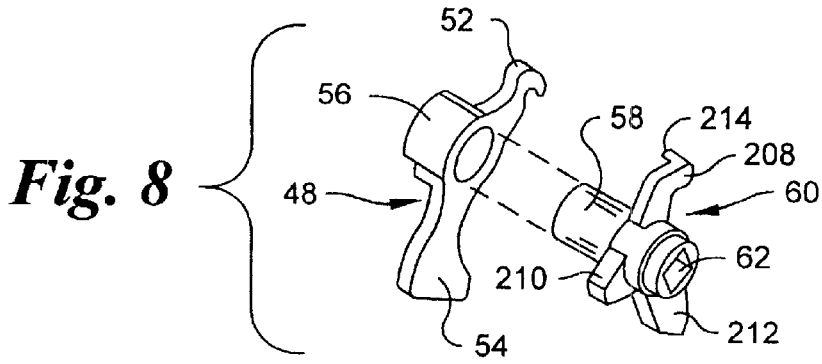
FIG. 8 is a perspective exploded view of a deadbolt lever and a thumbturn lever used in the mortise lock assembly of FIG. 1.

Means are provided for biasing the deadbolt 36 to the extended position. Referring to FIGS. 2 and 8, the deadbolt biasing means comprises a deadbolt lever 48 and a biasing mechanism 50. The deadbolt lever 48 (FIG. 8) is a flat piece having an upper leg 52, a lower leg 54 and a central, cylindrical hub 56. The deadbolt lever hub 56 is journaled on a rearwardly depending cylindrical shaft 58 of a thumbturn lever 60. The ends of the shaft 58 are rotatably received in corresponding openings in the side walls 24, 26 of the case. The thumbturn lever shaft 58 has a square-shaped opening 62 for receiving the spindle of a conventional thumb turn (not shown). The lower leg 54 of the deadbolt lever 48 is positioned in the slot 47 in the tail portion of the deadbolt 48. The end of the upper leg 52 of the deadbolt lever 48 is hook-shaped. The biasing mechanism 50 of the deadbolt biasing means comprises a coil spring 64. One end of the coil spring 64 is fixed over the hook on the upper leg 52 of the deadbolt lever 48 and the other end of the coil spring is fixed to a spring plate 66 secured to the case side wall 26. The coil spring 64 biases the deadbolt lever 48 in a counter-clockwise direction against the forward end of the slot 47 in the deadbolt tail portion 46 for moving the deadbolt 36 to the extended position.

Figure 9:
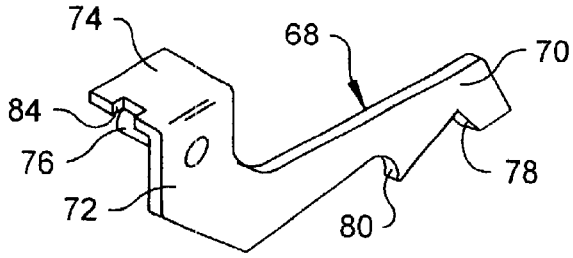
FIG. 9 is a perspective view of a deadbolt stop lever used in the mortise lock assembly of FIG. 1.

Means for blocking projection of the deadbolt 36 are also provided. Referring to FIGS. 2 and 9, the deadbolt projection blocking means comprises a deadbolt stop lever 68 and means for biasing the stop lever to a blocking position with respect to the deadbolt 36. The deadbolt stop lever 68 is an L-shaped piece having a long forward leg 70 and a shorter rearward leg 72. The rearward leg 72 has a side portion 74 depending from the end of the rearward leg. An inwardly depending sleeve 76 is fixed to the rearward leg 72. The sleeve 76 rotatably fits over a pin (not shown) integral with the case side wall 26. A downwardly and forwardly extending cam surface 78 is formed on the lower edge of the end of the forward leg 70 of the stop lever 68. A curved recess 80 is formed spaced from the end of the forward leg 70. The deadbolt stop lever 68 is biased in a clockwise direction by the stop lever biasing means, including a torsion spring 82. One end of the torsion spring 82 fits in a slot 84 in the side portion 74 of the stop lever 68 and the other end against the rear wall 34 of the case. The stop lever 68 is thus biased into the deadbolt blocking position where the recess 80 in the stop lever 68 fits over a lug 86 extending transversely from the deadbolt tail portion 46. In this position, the deadbolt 36 is retained in the retracted position against the force of the deadbolt biasing means.

A latch assembly 88 for use in the mortise lock assembly 20 of the present invention is seen in FIG. 2. The latch assembly 88 comprises the latch bolt 38 including a bolt head 90 and an integral latch tail 92, an anti-friction latch 94, a coil spring 96, a spring flange 98, and a tail plate 100. The bolt head 90 includes a beveled face 102 and a slot 104. The anti-friction latch 94 is pivotally mounted in the slot 104. The latch tail 92 extends from the rear of the bolt head 90. The tail plate 100 is fixed to the other end of the latch tail 92. The tail plate 100 is generally square-shaped. The upper and lower sides of the tail plate ride against the side walls 24, 26 of the case 32. The front lower surface of the tail plate 100 has a retraction surface 106.

The latch bolt 38 is slideably mounted in the housing for movement between the extended position and a retracted position. The latch tail 92 extends rearwardly from the bolt head 90 through a guide slot formed in a boss 108 fixedly mounted between the side walls 24, 26 for guiding and supporting the linear reciprocal movement of the latch bolt 38. The coil spring 96 is held in compression between the bolt head 90 and the spring flange 98, which is urged against the boss 108, for normally biasing the latch bolt 38 outwardly to the extended position.

Figure 3:
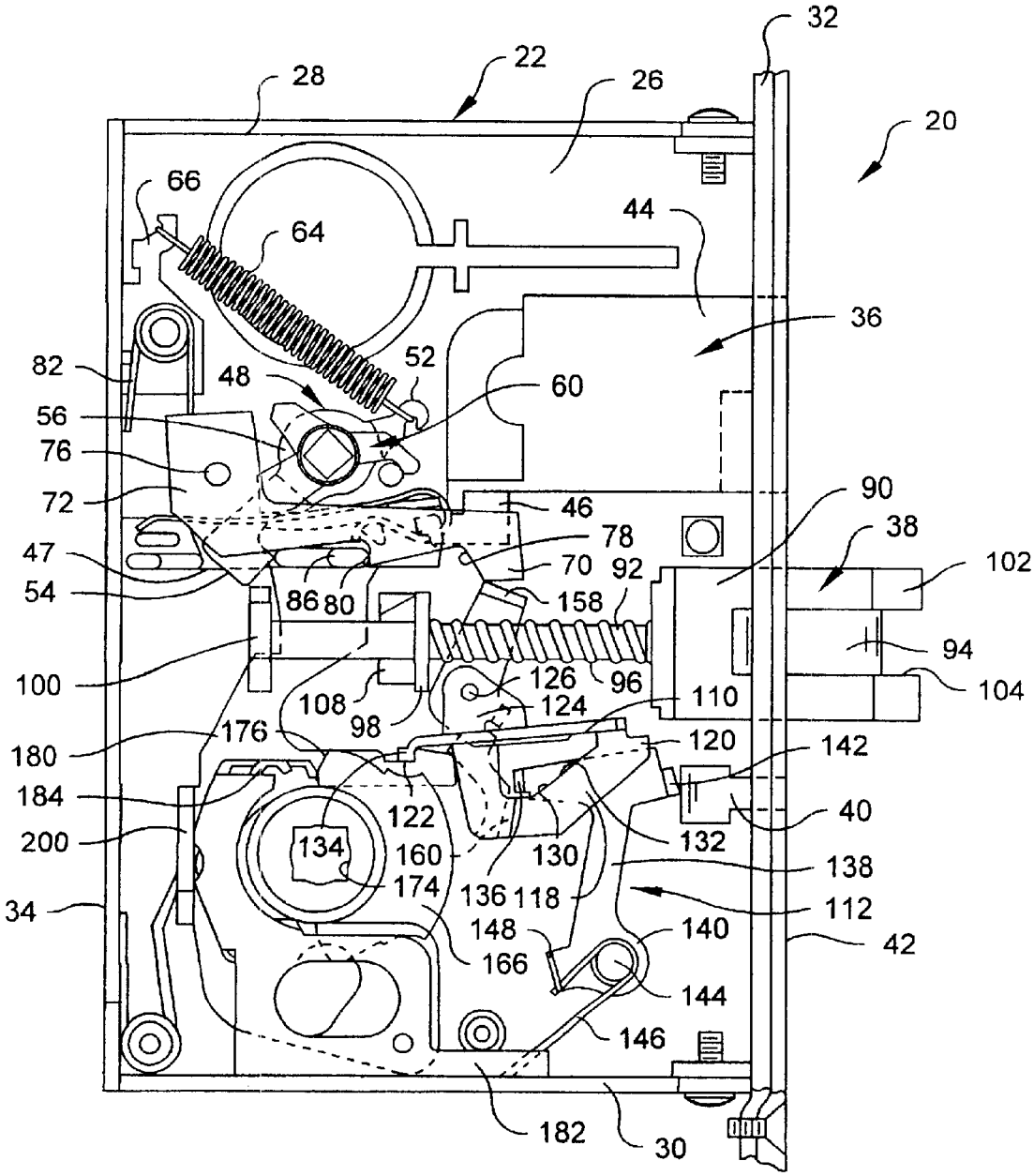
FIG. 3 is the same view of the mortise lock assembly of FIG. 2 but showing the auxiliary latch in the retracted position.
Figure 10:
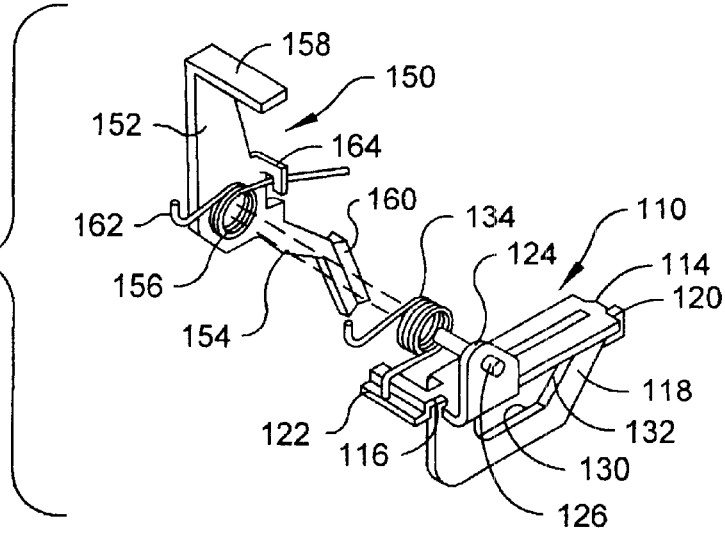
FIG. 10 is a perspective exploded view of a deadlocking lever and a release lever used in the mortise lock assembly of FIG. 1.

Means for deadlocking the latch bolt 38 in the extended position is also provided. Referring to FIGS. 2 and 10, the deadlocking means comprises the auxiliary bolt 40, a deadlocking lever 110 and an auxiliary latch lever 112. The auxiliary bolt 40 is conventional and is pivotally mounted in the housing 22 for movement between the extended position and a retracted position inside the housing. The deadlocking lever 110 (FIG. 10) is a flat plate having a forward end 114 and a rearward end 116 with a depending side portion 118. The forward end 114 of the deadlocking lever 110 has a forwardly facing blocking surface 120. The rearward end 116 of the deadlocking lever 110 has a lip 122 which forms a spring support surface. An ear 124 extends upwardly from the rear of the deadlocking lever 110 adjacent the lip 122. The ear 124 has an integral shaft 126 which is rotatably received in a hollow cylindrical post (not shown) projecting from the case side wall 26. The depending side portion 118 of the deadlocking lever 110 has an opening 130 which defines a generally forwardly and upwardly inclined cam surface 132. A torsion spring 134 fits over the post about which the deadlocking lever 110 rotates. One end of the spring 134 engages the spring flange 98 and the other end engages the lip 122 on the deadlocking lever 110 for biasing the deadlocking lever in a counterclockwise direction to a position where the blocking surface 120 is rearward of and in the path of the latch bolt 38 (FIG. 3).

The auxiliary latch lever 112 (FIG. 2) comprises a flat generally T-shaped piece having an upper leg 138 and a lower leg 140. A camming pin 136 is integral with the inner end of the upper leg 138. The camming pin 136 is received within the opening 130 in the deadlocking lever 110. A tab 142 projects laterally from the forward end of the upper leg 138 and is disposed adjacent to the inner surface of the auxiliary bolt 40. The auxiliary latch lever 112 is pivotally supported in the housing 22 at its lower leg 140 by a pin 144. A torsion spring 146 surrounds the pin 144 and acts between a spring tab 148 on the lower leg 140 of the auxiliary latch lever 112 and the bottom wall 30 of the case 22 to bias the auxiliary latch lever in a clockwise direction thus continually forcing the auxiliary bolt 40 to the extended position.

When the auxiliary bolt 40 is in the projected position, the camming pin 136 on the auxiliary latch lever 112 engages the upper end portion of the cam surface 132 on the deadlocking lever 110 which retains the deadlocking lever out of the path of the latch bolt 38. Referring to FIG. 3, when the door is closed, the latch bolt 38 is retracted by engagement with the strike plate and is projected to the extended position by force of the spring 96 into the strike. At the same time, the auxiliary bolt 40 engages the strike plate or door frame and is depressed and held in the retracted position. The auxiliary bolt 40 engages the auxiliary latch lever 112 causing the auxiliary latch lever to pivot in a counterclockwise direction. Since the camming pin 144 moves rearward, the deadlocking lever 110 is allowed to pivot in a counterclockwise direction under the biasing force of the compression spring 134 as the camming pin 136 travels along the camming surface. The deadlocking lever 110 thus assumes the blocking position where the abutment surface 120 is disposed behind the latch bolt head 90 preventing manual depression of the latch bolt 38.

A deadbolt release lever 150 (FIGS. 2 and 10) fits under the deadlocking lever 110 against the case side wall 26. The deadbolt release lever 150 (FIG. 10) is an L-shaped plate having an upper leg 152, a lower leg 154 and a central opening 156. The central opening 156 rotatably fits over the hollow cylindrical post which receives the shaft 126 on the deadlocking lever 110. A camming flange 158 projects from the end of the upper leg 152 of the release lever 150 just rearward of the cam surface 78 on the stop lever 68. The lower leg 154 of the release lever has a forwardly facing engaging surface 160 adjacent the cam pin 136 on the auxiliary latch lever 112. A torsion spring 162 surrounds the pin. One end of the spring 162 engages the spring flange 98 and the other end engages a tab 164 on the release lever 150 adjacent the central opening 156 for biasing the release lever in a counter clockwise direction. Thus, when the door is closed and the auxiliary latch lever 112 is pivoted inward by the auxiliary bolt 40, the cam pin 136 engages the engaging surface 160 on the release lever 150 and moves the release lever in a clockwise direction.

Figure 11:
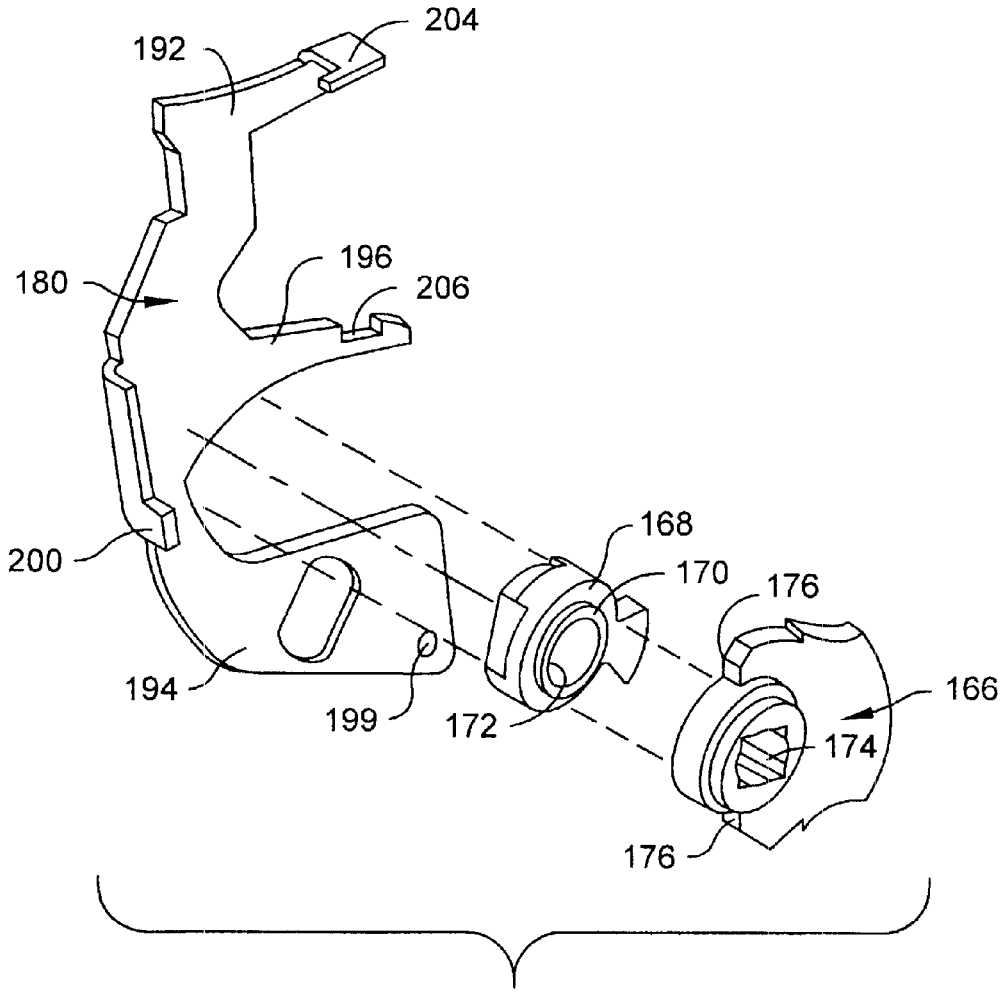
FIG. 11 is a perspective exploded view of components which comprise the latch operator used in the mortise lock assembly of FIG. 1.

The latch operator comprises means for retracting the deadbolt 36 and latch bolt 38, including an inside or outside knob or lever handle (not shown). Referring to FIGS. 2 and 11, the retracting means comprises a rollback hub 166 and a nylon bearing 168. The bearing 168 is non-rotatably mounted in the case side wall 26 below the latch assembly 88. The hub 166 is rotatably journaled between the bearing 168 and the cap side wall 24. The bearing 168 has a raised annular flange 170 which fits in a corresponding annular recess (not shown) in the hub 166. The bearing 168 has a circular pass through opening 172 for receiving a spindle drive (not shown) connecting the knobs or lever handles. The hub 166 includes a star-shaped aperture 174 for non-rotatable connection to the spindle drive for rotating the hub 166. The hub 166 has upper and lower rollback surfaces 176 which face the rear wall 34 of the case 22. The embodiment of the lock shown and described herein is used in a setting, such as a hotel, where access from the outside of the door is by electronic means using, for example, a key card. The single hub operable by both the inside and outside latch operators is typical for mortise locks of this type. It is understood that a pair of hubs independently operable by the inside and outside latch operators, respectively, could also be used in the mortise lock of the present invention.

Figure 4:
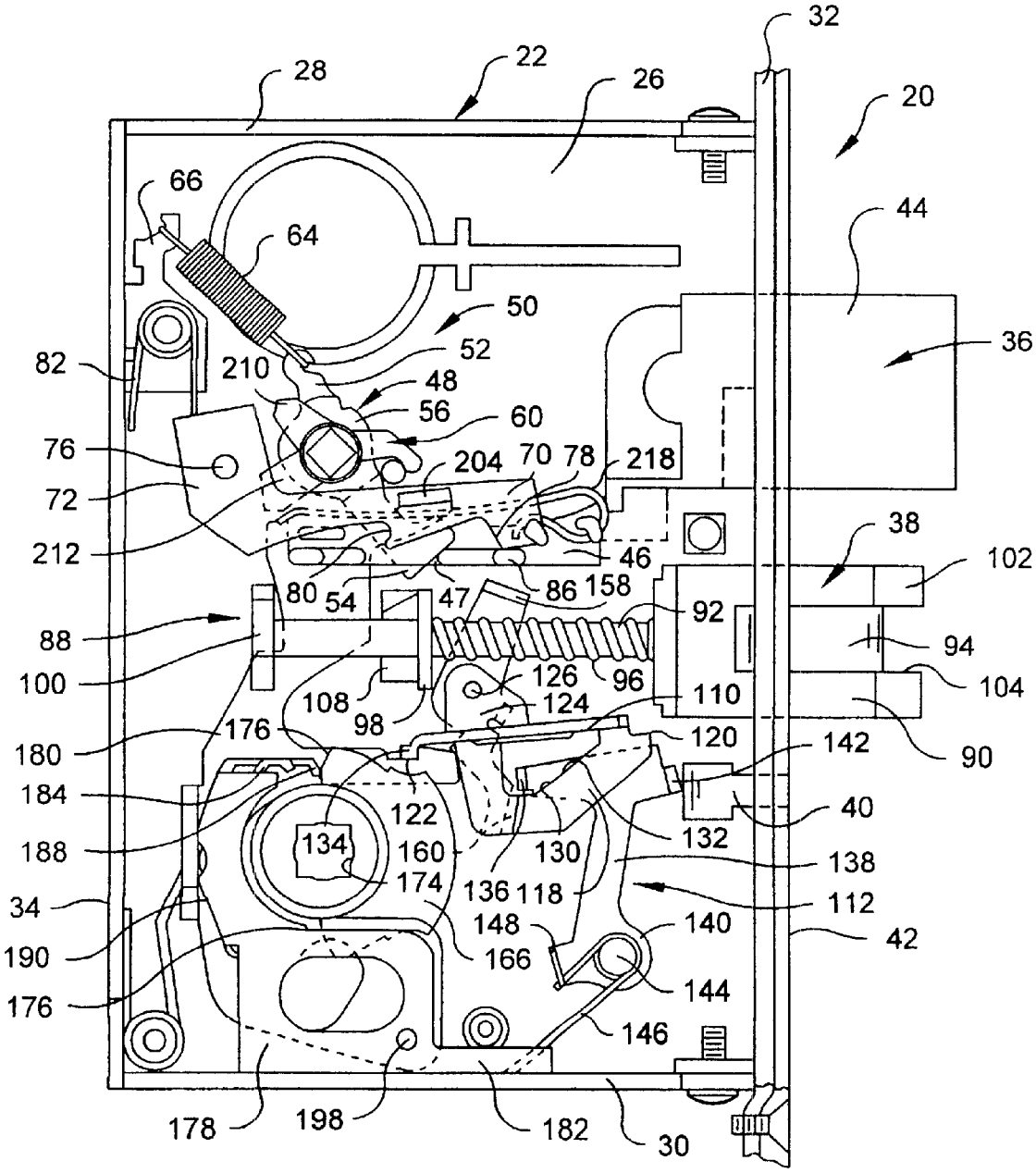
FIG. 4 is the same view of the mortise lock assembly of FIG. 3 but showing the deadbolt in the extended position.

The retracting means also includes a retractor shoe 178 and a hub lever 180 (FIG. 4). The retractor shoe 178 is substantially L-shaped and mounted for linear movement within the case 22. A front portion of the shoe 182 slides between the bottom wall 30 and a post integral with the case side wall 26. A transverse boss 184 at the top of the shoe 178 fits in a slot 186 (FIG. 1) in the cap side wall 24 for guiding the linear movement of the shoe 178. The shoe 178 has forwardly facing bearing surfaces 188 for engaging the rollback surfaces 176 of the hub 166 and a rearwardly facing bearing surface 190. In this arrangement, the shoe 178 moves linearly rearward in response to rotation of the hub 166 in either direction.

The hub lever 180 (FIG. 11) comprises a generally flat plate having an upper arm 192, lower arm 194 and an intermediate forwardly extending arm 196. The hub lever 180 is pivotally supported within the case 22 (FIG. 2) against the case side wall 26 on a pin 198 which is received in a hole 199 in the lower arm 194 below and in front of the hub 166. The hub lever 180 extends to the rear of the hub 166 and has a first laterally projecting tab 200 adjacent the rearward bearing surface 190 of the shoe 178. A torsion spring 202 acts between the rear wall 34 and the tab 200 to bias the hub lever 180 into operative engagement with the retractor shoe 178 and the shoe toward engagement with the roll back hub 166 for restoring the hub to the neutral or home position when the knob or handle is released. The hub lever 180 continues upwardly and lies adjacent to the retraction surface 106 of the tail plate 100. The upper arm 192 of the hub lever 180 has a transversely projecting arm 204 for engaging the deadbolt lever 48 when the deadbolt 36 is in the extended position for retracting the deadbolt in response to rotation of the hub 166, as will be described below.

The mortise lock assembly 20 of the present invention is mounted in a door. As seen in FIG. 2, when the door is open, the deadbolt 36 is held in the retracted position by the stop lever 68. When the door is closed, the latch bolt 38 automatically retracts when the anti-friction latch 94 and the beveled face 102 of the bolt head 90 engage the strike plate in the door frame. Initially, the anti-friction latch 94 engages the strike plate pivoting the anti-friction latch in the bolt head 90. As the anti-friction latch 94 pivots, the anti-friction latch works against the front wall 32 of the case 22 driving the latch bolt 38 rearward into the case 22. When the door is closed and in the door frame, the coil spring 96 returns the latch bolt 38 to the extended position.

During door closing, the auxiliary bolt 40 contacts the strike plate on the door frame, or the door frame itself, and is driven to the retracted position, as seen in FIG. 3. As the auxiliary bolt 40 is forced to the retracted position, the inner surface of the auxiliary bolt contacts the transverse tab 142 on the upper leg 138 of the auxiliary latch lever 112 for rotating the lever. During rotation, the pin 136 on the inner end of the upper leg 138 of the auxiliary latch lever 112 contacts and rotates the deadbolt release lever 150. The cam flange 158 on the upper leg 152 of the release lever 150 engages the cam surface 78 of the deadbolt stop lever 68 and cams the stop lever in a counterclockwise direction relative to the lug 86 until the lug engages the edge of the stop lever 68 adjacent the recess 80. In this position, the force of the deadbolt biasing means is sufficient to move the stop lever 68 to the release position thereby projecting the deadbolt 36 (FIG. 4). Thus, when the door is closed, the deadbolt 36 is released and automatically extends from the housing 22. Both the deadbolt 36 and latch bolt 38 are received in openings disposed in the opposing strike plate opposite the housing in the doorjamb to secure the door in place. When the deadbolt 36 is in the extended position, the lower leg 54 of the deadbolt lever 48 engages the front wall of the slot 47 preventing the deadbolt 36 from being manually forced back to its retracted position.

Figure 5:
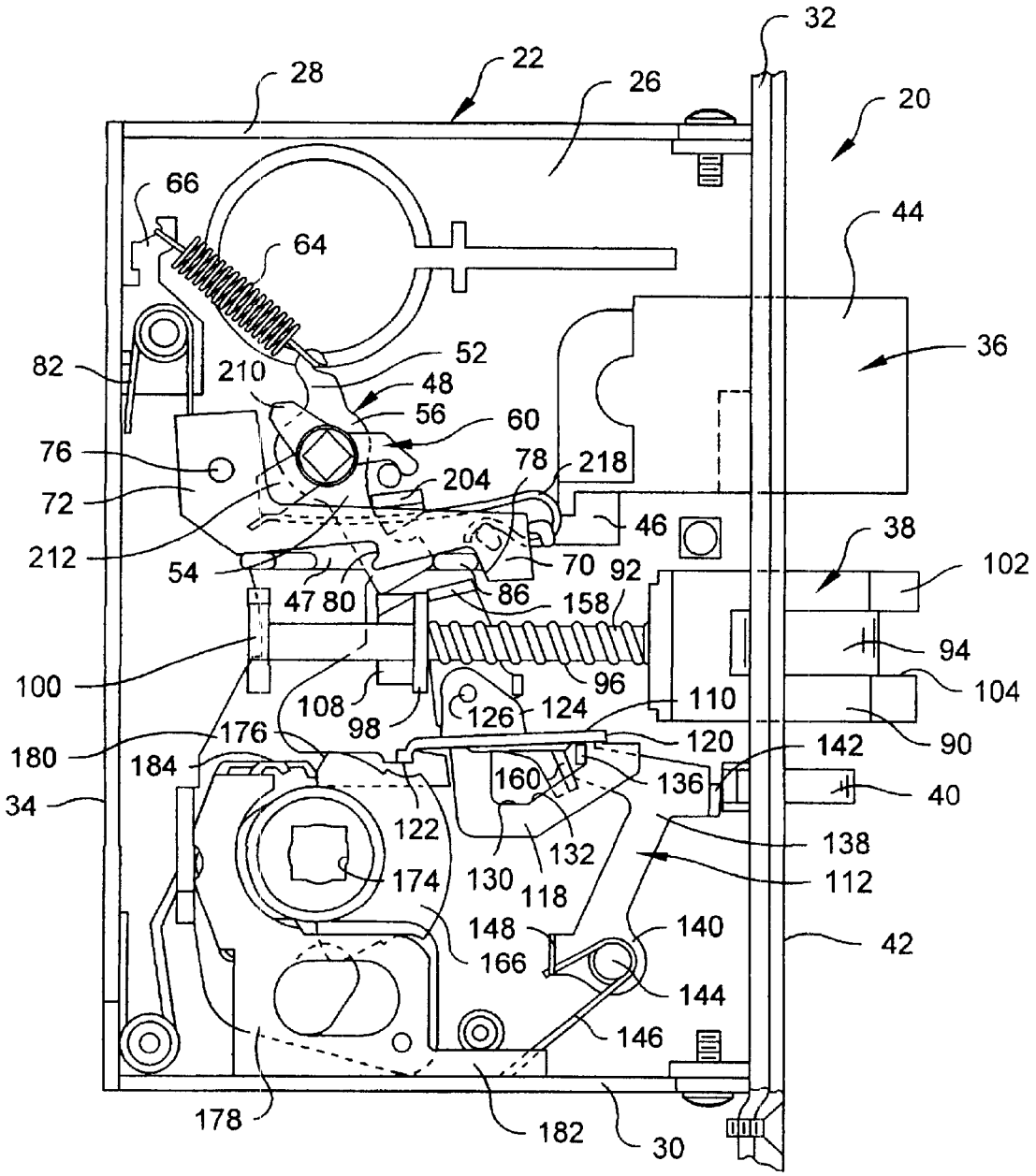
FIG. 5 is the same view of the mortise lock assembly of FIG. 4 but showing the position of the lock components upon initial actuation of the latch operator.

The latch operator is operable to retract the deadbolt 36 and latch bolt 38 to open the door. This assumes in the case of an electronic lock, that the means for locking the latch operator against rotation is not engaged. The position of the lock components upon initial operation of the latch operator is shown in FIG. 5. Rotating the latch operator imparts rotation to the hub 166. Rotation of the hub 166 in either direction causes one of the rollback surfaces 176 to engage the respective forwardly facing bearing surface 188 of the retractor shoe 178 moving the shoe linearly rearward toward the rear wall 34 of the case 22. The rearward bearing surface 190 of the shoe 178 engages the hub lever tab 200 to pivot the hub lever 180 in a counterclockwise direction. As seen in FIG. 4, when the door is closed, the lip 122 on the deadlocking lever 110 is directly above and in the path of a notch 206 in the intermediate arm 196 of the hub lever 180. Initial rotation of the hub lever 180 in the counterclockwise direction causes the notch 206 on the intermediate arm 196 of the hub lever 180 to engage the lip 122 of the deadlocking lever 110. As the hub lever 180 rotates, the deadlocking lever 110 is pivoted in a clockwise direction by the intermediate arm 196 on the hub lever 180 and out of the path of the latch bolt 38.

Figure 6:
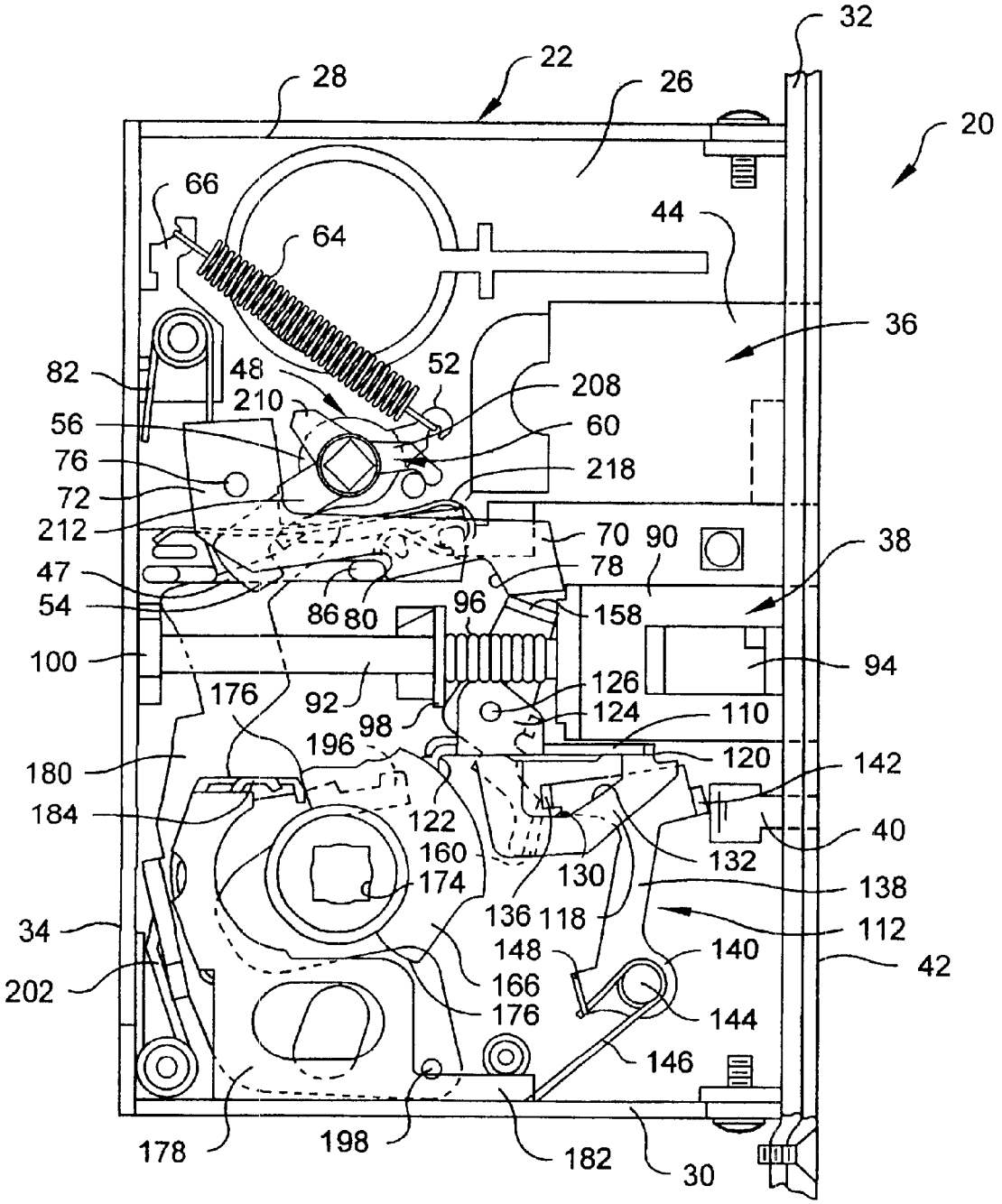
FIG. 6 is the same view of the mortise lock assembly of FIG. 5 but showing the latch bolt and deadbolt retracted into the case by actuation of a latch operator.

Continued rotation of the hub lever 180 causes the hub lever to engage the retraction surface 106 of the tail plate 100 to move the tail plate and connected latch bolt 38 to the retracted position (FIG. 6). Simultaneously, the transverse arm 204 on the upper arm 192 of the hub lever 180 contacts the deadbolt lever 48 to rotate the deadbolt lever in a clockwise direction. The deadbolt lever 48 engages the rear wall of the slot 47 for retracting the deadbolt 36. The door is now free to be opened. As the free edge of the door leaves the vicinity of the strike plate, the auxiliary latch 40 projects from the housing under the biasing force on the auxiliary latch lever 112. This movement allows the release lever 150 to be biased to return to the position where the upper leg 152 of the release lever is out of engagement with the cam surface 78 of the stop lever 68. The deadbolt stop lever 68, which is biased in a clockwise direction, is thus allowed to seat over the lug 86 on the tail piece of the deadbolt 36 thereby preventing the deadbolt from extending when the latch operator is released. When the latch operator is released, the components of the lock 20 assume the position shown in FIG. 2. The hub 166 and shoe 178 are biased to return to their neutral position and the coil spring 96 returns the latch bolt 38 to the extended position. In this condition of the lock 20, the latch operator is operable to retract the latch bolt 38, but the deadbolt 36 is held in the retracted position.

The deadbolt 36 may be selectively moved from the retracted position to the extended position by operation of the thumb turn in a conventional manner. As seen in FIG. 8, the thumbturn lever 60 has three legs: an upper leg 208 and two lower legs 210, 212. The upper leg 208 has a rearwardly depending tab 214. When joined with the deadbolt lever 48, the tab 214 on the upper leg 208 is disposed adjacent to the deadbolt lever 48. Referring to FIG. 2, the upper leg 208 of the thumbturn lever 60 rests generally horizontally on a pin 216 integral with the case side wall 26. The two lower legs 210, 212 extend generally horizontally rearwardly. The lower of the two legs 212 at the rearward end of the thumbturn lever 60 is engaged by a leaf spring 218 carried by the deadbolt 36.

Rotation of the thumb turn causes corresponding rotation of the thumbturn lever 60. As the thumbturn lever 60 rotates, the upper rearwardly extending leg 210 contacts the upwardly extending rear leg 72 of the deadbolt stop lever 68.

Figure 7:
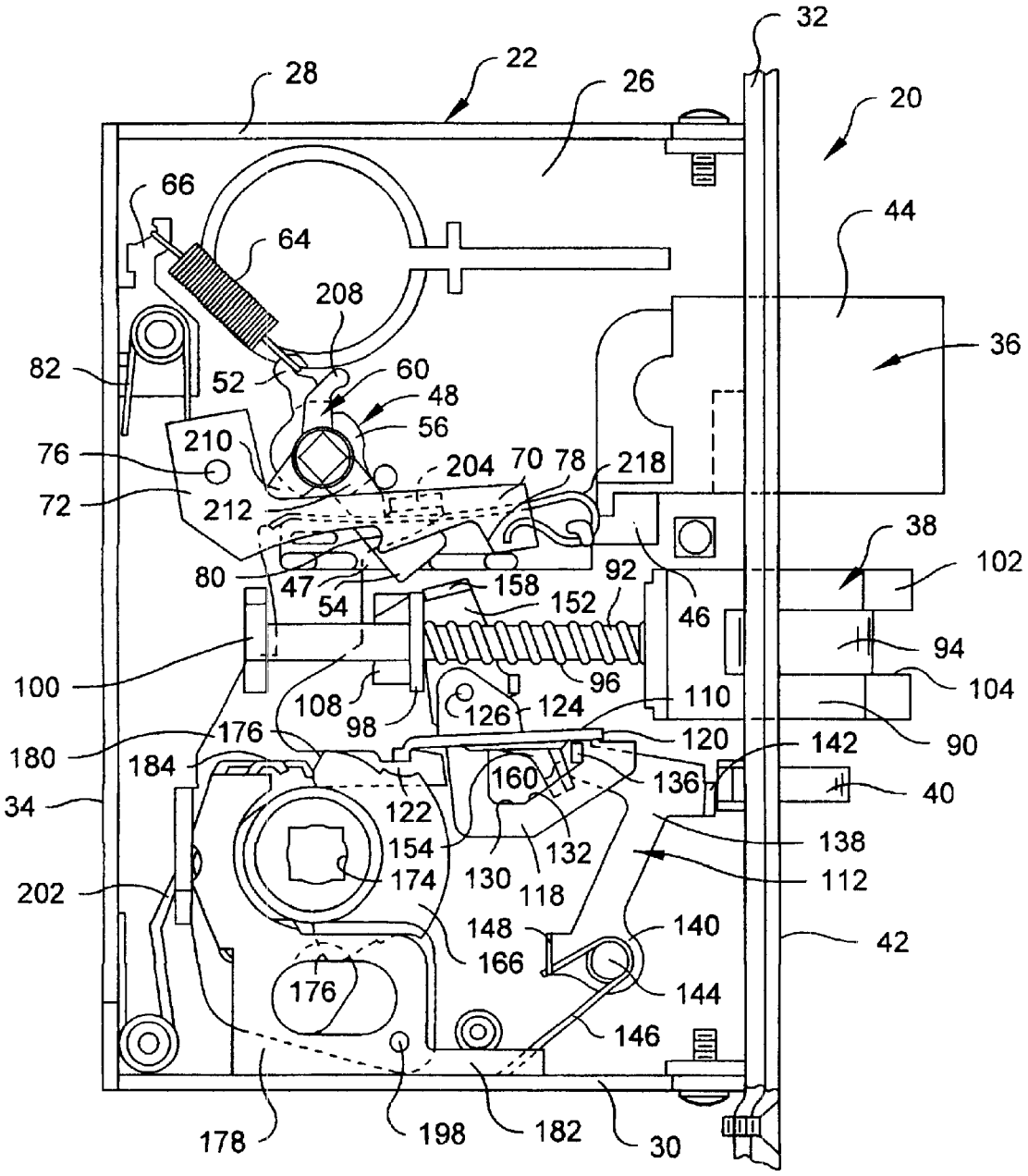
FIG. 7 is a side elevation view of the mortise lock assembly as shown in FIG. 2 after actuation of the thumb turn to project the deadbolt to the extended position.

This action rotates the deadbolt stop lever 68 in a counterclockwise direction a sufficient distance to free the deadbolt 36 for projection to the extended position under the force of the deadbolt biasing means in the same manner as described above. As the lower leg 212 of the rearward end of the thumbturn lever 60 clears the leaf spring 218 and the thumbturn lever nears a vertical position, the leaf spring provides upward pressure on the two lower legs 210, 212 so that as the thumbturn lever approaches the spring force positively fixes the thumbturn lever in place (FIG. 7). When the deadbolt 36 and latch bolt 38 are retracted by the latch operator, as described above, the deadbolt lever 48 engages the tab 214 on the upper leg 208 of the thumbturn lever 60 and rotates the thumbturn lever in a clockwise direction back to the generally horizontal position of FIG. 2. As the thumbturn lever 60 reaches the horizontal position, the leaf spring 218 acts upwardly on the lower rearward leg 212 to fix the thumbturn lever in this position.

As noted above, the previously described embodiment of the mortise lock of the present invention is particularly useful in an electronic lock such as for use in a hotel room door. However, it is understood that the automatic deadbolt mechanism of the present invention may be used in other settings and with other lock components, for example, as shown in co-pending application Ser. Nos. 09/346,840 and 09/577,057, the contents of which are hereby incorporated by reference.

The previously described embodiments of the present invention have many advantages, including providing a mortise lock with an automatic deadbolt in which the cooperating components are smoothly and easily pivoted to their operative positions. The result is an automatic deadbolt mechanism which requires minimal force upon door closing to trigger deadbolt projection. Moreover, subsequently retract of the deabolt using the latch operator is facilitated. The configuration of the deadbolt stop lever and biasing mechanism ensures positive retention of the deadbolt once retracted with no accidental projection.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, a pair independent hubs could be used instead of a single hub for independent operation by inside and outside latch operators, respectively. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. An automatic deadbolt mechanism for a mortise lock assembly of the type mounted in the free edge of a door such that, when the door is closed, the mortise lock assembly is adjacent a strike plate on a doorjamb and comprises a housing for accommodating components of the lock including the automated deadbolt mechanism, a deadbolt mounted in the housing for movement relative to the housing between a retracted position where the deadbolt is inside the housing and an extended position where a portion of the deadbolt extends outside the housing, the deadbolt biased in the extended position, and a deadbolt retractor to move the deadbolt to the retracted position, the automatic deadbolt mechanism comprising:

a blocking element pivotally mounted in the housing for movement relative to the housing, the blocking element having a blocking surface and a cam surface, the blocking element having a first position where the blocking surface engages the deadbolt for holding the deadbolt in the retracted position and a second position where the blocking surface does not engage the deadbolt; and a blocking element pivot for moving the blocking element to the second position, the blocking element pivot comprising:

a sensor mounted in the housing for movement relative to the housing between an extended position where a portion of the sensor extends outside the housing and a retracted position where a portion of the sensor is inside the housing, the sensor adapted to contact the strike plate for movement to the retracted position upon closing the door;

a trigger hammer pivotally mounted in the housing adjacent the sensor for engagement and pivotal movement by the sensor when the sensor is moved to the retracted position, and a release lever pivotally mounted in the housing and having a drive surface and a cam surface the drive surface adjacent the cam surface of the blocking element when the blocking element is in the first position and the cam surface adjacent the trigger hammer for engagement and movement by the trigger hammer when the trigger hammer is pivoted by the sensor, the drive surface of the release lever engaging the cam surface of the blocking element when the release lever is rotated by the trigger hammer for moving the blocking element the second position, whereby the blocking element pivot moves the blocking element to the second position when the sensor is in the retracted position so that the deadbolt automatically moves to the extended position when the door is closed.

2. An automatic deadbolt mechanism as recited in claim 1, wherein the deadbolt includes a second portion which is adapted to remain within the housing in both the retracted and extended positions of the deadbolt and a lug extending from the second portion of the deadbolt, and wherein the blocking surface comprises a hook which in the first position of the blocking element engages the lug for holding the deadbolt in the retracted position.

3. A mortise lock assembly for mounting in a free edge of a door adjacent a strike plate on a doorjamb when the door is closed, the mortise lock comprising:

a housing;

a deadbolt mounted in the housing for movement relative to the housing between a retracted position where the deadbolt is inside the housing and an extended position where a portion of the deadbolt extends outside the housing, the deadbolt biased in the first position;

a deadbolt retractor for moving the deadbolt from the extended position to the retracted position;

a blocking element mounted in the housing for pivotal movement relative to the housing and having a blocking surface, the blocking element having a first position where the blocking surface engages the deadbolt for holding the deadbolt in the retracted position and a second position where the blocking surface does not engage the deadbolt, the blocking element biased in the first position;

a blocking element pivot for moving the blocking element to the second position, the blocking element pivot comprising:

a sensor mounted in the housing for movement relative to the housing between an extended position where a portion of the sensor extends outside the housing and a retracted position where the sensor is inside the housing, the sensor adapted to contact the strike plate for movement to the retracted position upon closing the door;

a trigger hammer pivotally mounted in the housing adjacent the sensor for engagement and pivotal movement by the sensor when the sensor is moved to the retracted position, and a release lever pivotally mounted in the housing and having a drive surface and a cam surface, the drive surface adjacent the cam surface of the blocking element when the blocking element is in the first position and the cam surface is adjacent the trigger hammer for engagement and movement by the trigger hammer when the trigger hammer is pivoted by the sensor, the drive surface of the release lever engaging the cam surface of the blocking element when the release lever is rotated by the trigger hammer for moving the blocking element to the second position, wherein the blocking element pivot moves the blocking element to the second position when the sensor is in the retracted position, so that the deadbolt automatically moves to the extended position when the door is closed.

4. A mortise lock assembly as recited in claim 3, wherein the deadbolt includes a second portion which is within the housing in both the retracted and extended positions of the deadbolt and a lug extending from the second portion of the deadbolt, and wherein the blocking surface comprises a hook which in the first position of the blocking element engages the lug for holding the deadbolt in the retracted position.

5. A mortise lock for mounting in a free edge of a door and for being adjacent a strike plate on a doorjamb when the door is closed, the mortise lock comprising:

a housing;

a deadbolt mounted in the housing and movable between a retracted position where the deadbolt is inside the housing and an extended position where a portion of the deadbolt extends outside of the housing, the deadbolt biased in the extended position;

a deadbolt stop mounted in the housing and movable between a deadbolt engaged position and a deadbolt released position, the deadbolt stop biased in the engaged position;

a latch bolt mounted in the housing and movable along a path between a retracted position where the latch bolt is inside the housing and an extended position where a portion of the latch bolt extends outside of the housing, the latch bolt biased in the extended position;

a latch deadlock mounted in the housing and movable between an extended position in the path of the latch bolt and a retracted position spaced from the path of the latch bolt;

an auxiliary latch mounted in the housing and movable between a retracted position where the auxiliary latch is inside the housing and an extended position wherein a portion of the auxiliary latch extends outside of the housing, the auxiliary latch biased in the extended position; and a retractor assembly mounted in the housing, the retractor assembly comprising a hub and a hub lever, the hub rotatably connected to the housing, the hub lever operably coupling the hub to the latch deadlock, the latch bolt and the deadbolt and rotatable between a first hub-lever position and a second hub-lever position, wherein the deadbolt stop moves to the released position, the deadbolt moves to the extended position, and the latch deadlock moves to the extended position in response to movement of the auxiliary latch to the retracted position when the auxiliary latch contacts the strike plate, wherein the latch deadlock moves to the retracted position, the latch bolt moves to the retracted position and the deadbolt moves to the retracted position when rotation of the hub pivots the hub-lever from the first hub-lever position to the second hub-lever position, and wherein the deadbolt stop moves to the engaged position in response to movement of the auxiliary latch to the extended position when the deadbolt is in the retracted position.

6. A automatic deadbolt mechanism comprising:

a deadbolt movable between a retracted position and an extended position;

a deadbolt lever biased in a first deadbolt-lever position and pivotable between the first deadbolt-lever position and a second deadbolt-lever position, the deadbolt lever operably coupled to the deadbolt and configured to cause the deadbolt to be in the extended position when the deadbolt lever is in the first deadbolt-lever position and to cause the deadbolt to be in the retracted position when the deadbolt lever is in the second deadbolt-lever position;

a deadbolt stop lever biased in a first deadbolt-stop-lever position and pivotable between the first deadbolt-stop-lever position and a second deadbolt-stop-lever position, the deadbolt stop lever releasably engageable with the deadbolt and configured to releasably retain the deadbolt in the retracted position when the deadbolt stop lever is in the first deadbolt-stop-lever position;

a thumbturn lever pivotable between a first thumbturn-lever position and a second thumbturn-lever position and between the second thumbturn-lever position and a third thumbturn-lever position, the thumbturn lever operably coupled to the deadbolt stop lever and the deadbolt lever and configured to cause the deadbolt stop lever to pivot from the first deadbolt-stop-lever position to the second deadbolt-stop-lever position when the thumbturn lever pivots from the first thumbturn-lever position to the second thumbturn-lever position and to cause the deadbolt lever to move the deadbolt from the retracted position to the extended position when the thumbturn lever pivots from the second thumbturn-lever position to the third thumbturn-lever position;

a hub lever biased in a first hub-lever position and pivotable between the first hub-lever position and a second hub-lever position, the hub lever operably coupled to the deadbolt lever and configured to cause the deadbolt lever to pivot from the first deadbolt-lever position to the second deadbolt-lever position ever when the hub lever pivots from the first hub-lever position to the second hub-lever position;

a deadbolt release lever biased in a first deadbolt-release-lever position and pivotable between the first deadbolt-release-lever position and a second deadbolt-release-lever position, the deadbolt release lever operably coupled to the deadbolt stop lever and configured to cause the deadbolt stop lever to pivot from the first deadbolt-stop-lever position to the second deadbolt-stop-lever position when the deadbolt release lever pivots from the first deadbolt-release-lever position to the second deadbolt-release-lever position; and a auxiliary latch lever biased in a first auxiliary-latch-lever position and pivotable between the first auxiliary-latch-lever position and a second auxiliary-latch-lever position, the auxiliary latch lever operably coupled to the deadbolt release lever and configured to cause the deadbolt release lever to pivot from the first deadbolt-release-lever position to the second deadbolt-release-lever position when the auxiliary latch lever pivots from the first auxiliary-latch-lever position to the second auxiliary-latch-lever position.

7. The mechanism according to claim 6, wherein:

the deadbolt lever has a deadbolt-lever hub from which a first leg and a second leg extend generally radially outwardly; and the thumbturn lever has a thumbturn-lever hub from which a first lobe, a second lobe, and a third lobe extend generally radially outwardly, the thumbturn-lever hub journaled with the deadbolt-lever hub, the first lobe operably coupled to the deadbolt, the second lobe operably coupled to the first leg of the deadbolt lever, and the third lobe has a boss operably coupled to the second leg of the deadbolt lever.

8. A automatic deadbolt mechanism comprising:

a deadbolt movable between a retracted position and an extended position;

a deadbolt lever biased in a first deadbolt-lever position and pivotable between the first deadbolt-lever position and a second deadbolt-lever position, the deadbolt lever operably coupled to the deadbolt and configured to cause the deadbolt to be in the extended position when the deadbolt lever is in the first deadbolt-lever position and to cause the deadbolt to be in the retracted position when the deadbolt lever is in the second deadbolt-lever position;

a deadbolt stop lever biased in a first deadbolt-stop-lever position and pivotable between the first deadbolt-stop-lever position and a second deadbolt-stop-lever position, the deadbolt stop lever releasably engageable with the deadbolt and configured to releasably retain the deadbolt in the retracted position when the deadbolt stop lever is in the first deadbolt-stop-lever position;

a latchbolt biased in an extended position and movable between the extended position and a retracted position;

a deadlocking lever biased in a first deadlocking-lever position and pivotable between the first deadlocking-lever position and a second deadlocking-lever position, the deadlocking lever configured to block movement of the latchbolt when the deadlocking lever is in the first deadlocking-lever position;

a hub lever biased in a first hub-lever position and pivotable between the first hub-lever position and a second hub-lever position, the hub lever operably coupled to the deadbolt lever, the latchbolt, and the deadlocking lever, the hub lever configured to cause the deadbolt lever to pivot from the second deadbolt-lever position to the first deadbolt-lever position, the deadlocking lever to pivot from the first deadlocking-lever position to the deadlocking-lever second position, and the latchbolt to move from the extended position to the retracted position when the hub lever pivots from the first hub-lever position to the second hub-lever position;

a deadbolt release lever biased in a first deadbolt-release-lever position and pivotable between the first deadbolt-release-lever position and a second deadbolt-release-lever position, the deadbolt release lever operably coupled to the deadbolt holding lever and configured to cause the deadbolt holding lever to pivot from the first deadbolt-holding-lever position to the second deadbolt-holding-lever position when the deadbolt release lever pivots from the first deadbolt-release-lever position to the second deadbolt-release-lever position; and a auxiliary latch lever biased in a first auxiliary-latch-lever position and pivotable between the first auxiliary-latch-lever position and a second auxiliary-latch-lever position, the auxiliary latch lever operatively coupled to the deadbolt release lever and the deadlocking lever and configured to cause the deadbolt release lever to pivot from the first deadbolt-release-lever position to the second deadbolt-release-lever position when the auxiliary latch lever pivots from the first auxiliary-latch-lever position to the second auxiliary-latch-lever position and to retain the deadlocking lever in the second deadlocking-lever position when the auxiliary latch lever is in the first auxiliary-latch-lever position.

9. The mechanism according to claim 8, further comprising a thumbturn lever pivotable between a first thumbturn-lever position and a second thumbturn-lever position and between the second thumbturn-lever position and a third thumbturn-lever position, the thumbturn lever operably coupled to the deadbolt stop lever and the deadbolt lever and configured to cause the deadbolt stop lever to pivot from the first deadbolt-stop-lever position to the second deadbolt-stop-lever position when the thumbturn lever pivots from the first thumbturn-lever position to the second thumbturn-lever position and to cause the deadbolt lever to move the deadbolt from the retracted position to the extended position when the thumbturn lever pivots from the second thumbturn-lever position to the third thumbturn-lever position.

* * * * *